US005208414A

United States Patent [19]

Yamada

[11] Patent Number: 5,208,414

[45] Date of Patent: May 4, 1993

[54] ACOUSTIC SIGNAL GENERATOR WITH MEANS FOR CHANGING THE TIME CONSTANT OF THE ENVELOPE SIGNAL

[75] Inventor: Kunio Yamada, Tokyo, Japan

[73] Assignee: Seikosha Co., Ltd., Tokyo, Japan

[21] Appl. No.: 760,543

[22] Filed: Sep. 16, 1991

[30] Foreign Application Priority Data

Nov. 30, 1990 [JP] Japan ..... 2-337299

[51] Int. Cl.[5] ..... G10H 1/057; G10H 7/00

[52] U.S. Cl. ..... 84/627; 84/663

[58] Field of Search ..... 84/627, 647, 648, 659, 84/660, 663, 702, 703, 738

[56] References Cited

U.S. PATENT DOCUMENTS 4,217,802 8/1980 DeForeit ..... 84/647 X
4,537,108 8/1985 Shiramizu ..... 84/648
5,014,587 5/1991 Taylor ..... 84/659

*Primary Examiner*—Stanley J. Witkowski
*Attorney, Agent, or Firm*—Jordan and Hamburg

[57] ABSTRACT

An acoustic signal synthesizer stores a plurality of different acoustic data and includes a separate D-A converter connected to receive each of the different acoustic data. The D-A converters are responsive to separate envelope generators for controlling their respective outputs. A controller controls the output of the acoustic data to the respective D-A converter and simultaneously controls the respective envelope generator output. The output of the converters are mixed.

2 Claims, 5 Drawing Sheets

ACOUSTIC SIGNAL GENERATOR WITH MEANS FOR CHANGING THE TIME CONSTANT OF THE ENVELOPE SIGNAL

FIELD OF THE INVENTION

The present invention relates to an acoustic signal synthesizer for synthesizing sound such as melody.

BACKGROUND OF THE INVENTION

This type of acoustic signal generator is disclosed in, for example, Japanese Laid-Open patent application No. 59-26789. When one sound is produced, its tone generally changes delicately as time elapses. Specifically, since high frequency components contained in the sound attenuate readily whereas low frequency components attenuate to a small extent, the condition (tone) of the sound changes delicately as time elapses. Therefore, according to the system disclosed in the foregoing application, three kinds of acoustic data are preset which correspond to the waveform of tone of a sound when it has just been produced, the waveform of tone when a certain time has elapsed after sound production so that the sound has attenuated correspondingly, and the waveform of tone when another certain time has elapsed so that the sound has correspondingly become more attenuated, these acoustic data are previously stored in three storage circuits (ROM) respectively. Then the waveforms of three sounds to be produced in succession are modified by the use of the three kinds of acoustic data, the resulting sound outputs are added digitally together, and the resulting output is converted from digital to analog form and modified by the use of one envelope signal; as a result, the three sounds are combined.

In the foregoing system of combining three sounds by the use of one envelope signal, when the time constant of the envelope signal is large, attenuation is dull; thus, the strength of sound increases as the number of overlapping sounds increases. On the contrary, when the time constant of the envelope signal is small, the sound is attenuated quickly; accordingly, two or more sounds produced earlier become too weak to hear, making it difficult to discriminate the overlapping of sounds.

SUMMARY OF THE INVENTION

Therefore, the object of the present invention is to make it possible to change the time constant of an envelope signal corresponding to each previously-produced sound at each time of generation of the subsequent sounds, thus to produce a virtually-natural composite sound from a plurality of acoustic signals.

In order to accomplish the foregoing object, an acoustic signal synthesizer according to the present invention comprises a plurality of storage circuits in which different acoustic data is stored individually, a time constant circuit for generating an envelope signal corresponding to each acoustic data in synchronism with the generation timing of that acoustic data and changing the time constant of the envelope signal in synchronism with the generation timing of another acoustic data generated later, a plurality of D-A converters for converting the acoustic data from each storage circuit from digital to analog form and performing envelope-processing by using the envelope signal corresponding to that acoustic data which is supplied from the time constant circuit, and a mixing circuit for combining the respective output signals of the D-A converters.

The time constant circuit may be modified to change the time constant at the generation timing of each acoustic data by using a pulse signal which is formed from a plurality of pulse signals of different duty cycle in synchronism with the generation timing of each acoustic data.

The time constant circuit may be modified such that it is provided with a plurality of resistors of different resistance and it changes the time constant at the generation timing of each acoustic data by selecting the resistors in synchronism with the generation timing of each acoustic data.

The time constant circuit may include a pulse signal composing circuit for receiving a plurality of pulse signals of different duty and a plurality of timing signals for generation of the acoustic data, and generating a pulse signal whose duty cycle changes at the generation timing of each acoustic data; and an envelope signal composing circuit for receiving the pulse signal from the pulse signal composing circuit, and generating an envelope signal whose attenuation factor changes at the generation timing of each acoustic data in synchronism with the start signal of generation timing of each acoustic data, which is supplied to the D-A converter.

The time constant of an envelope signal corresponding to each acoustic data which is generated in conformity with the generation timing of an acoustic data thereof is changed by the time constant circuit in synchronism with the generation timing of other later generated acoustic data, and each acoustic data is envelope-processed by using the corresponding envelope signal thus changed, whereby a virtually-natural composite sound is obtained.

DESCRIPTION OF THE PREFERRED EMBODIMENTS

Figure 1:
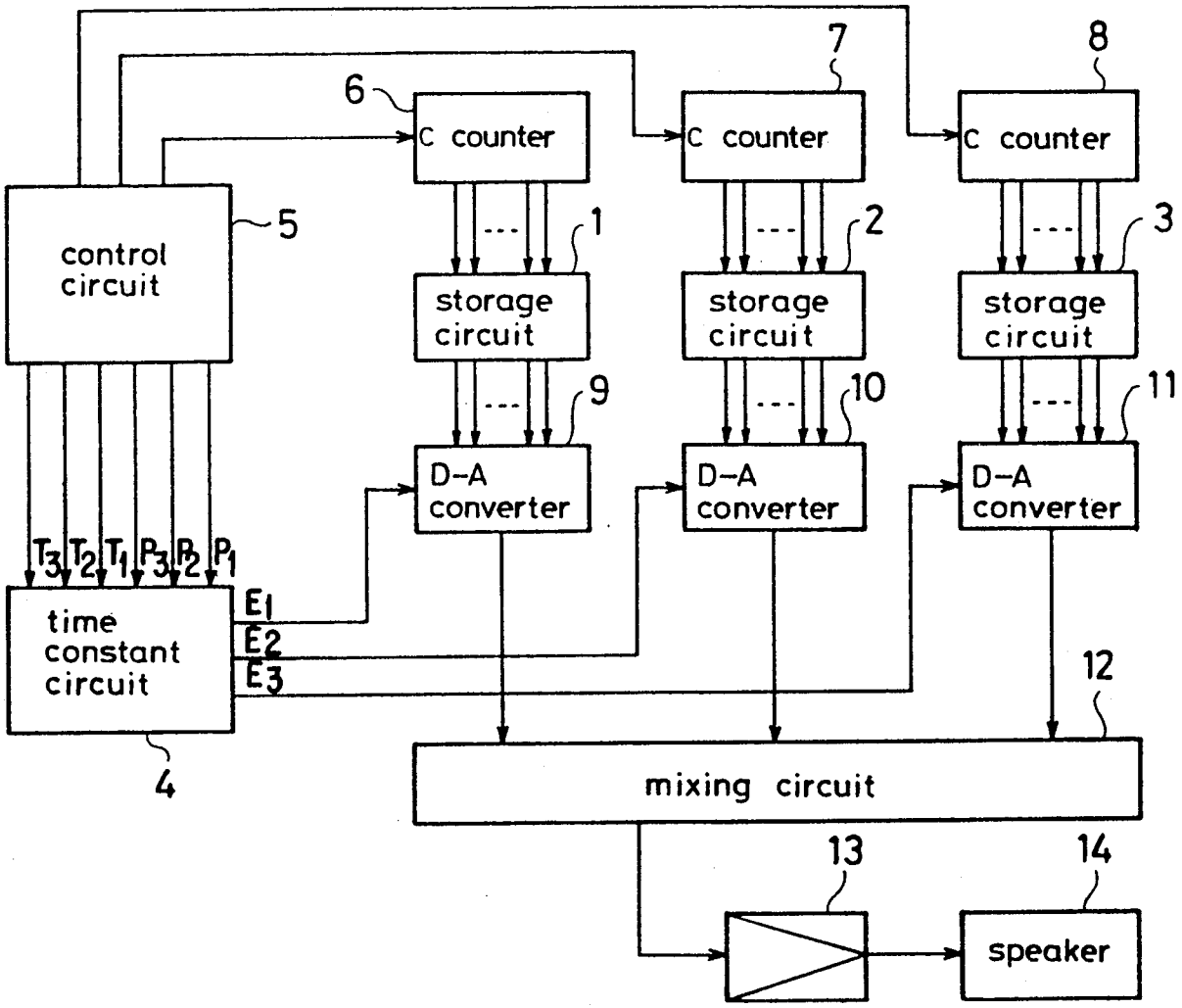
FIG. 1 is a block diagram showing an embodiment of the present invention.

In the block diagram of FIG. 1, storage circuits (ROM) 1, 2 and 3 are provided for, respectively, storing different acoustic data. Specifically, a plurality of different acoustic data corresponding to different sound sources, such as piano, violin, bell and the like are stored in these storage circuits. The number of storage circuits is identical to the number of sounds to be combined, e.g., three in the present embodiment.

In conformity with the generation timing of each acoustic data, an envelope signal corresponding to each acoustic data is generated, and a time constant circuit 4 is provided for changing the time constant of each envelope signal in synchronism with the generation timing of each later generated acoustic data.

A control circuit 5 supplies start signals P1, P2 and P3 and timing signals T1, T2 and T3 relating to the generation timing of each acoustic data to the time constant circuit 4.

Under the control of the control circuit 5, the acoustic data stored previously in the ROM's 1, 2 and 3 is read out in accordance with the value counted in counters 6, 7 and 8. The output signals from the ROM's 1, 2 and 3 are converted in D-A converters 9, 10 and 11 from digital to analog form and concurrently envelope-processed by the use of envelope signals E1, E2 and E3 from the time constant circuit 4.

The output signals of the D-A converters 9, 10 and 11 are combined in a mixing circuit 12, and the resulting signal is emitted from a speaker 14 in the form of sound after passing through an amplifier 13.

Figure 2:
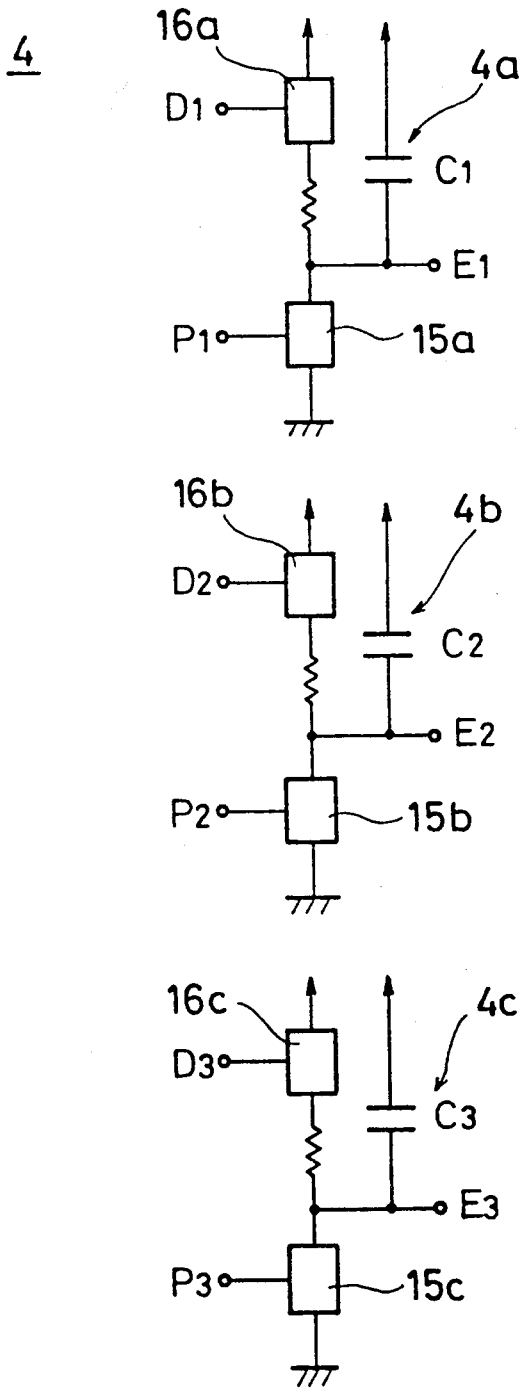
FIG. 2 is a circuit diagram showing an example of a time constant circuit.
Figure 3:
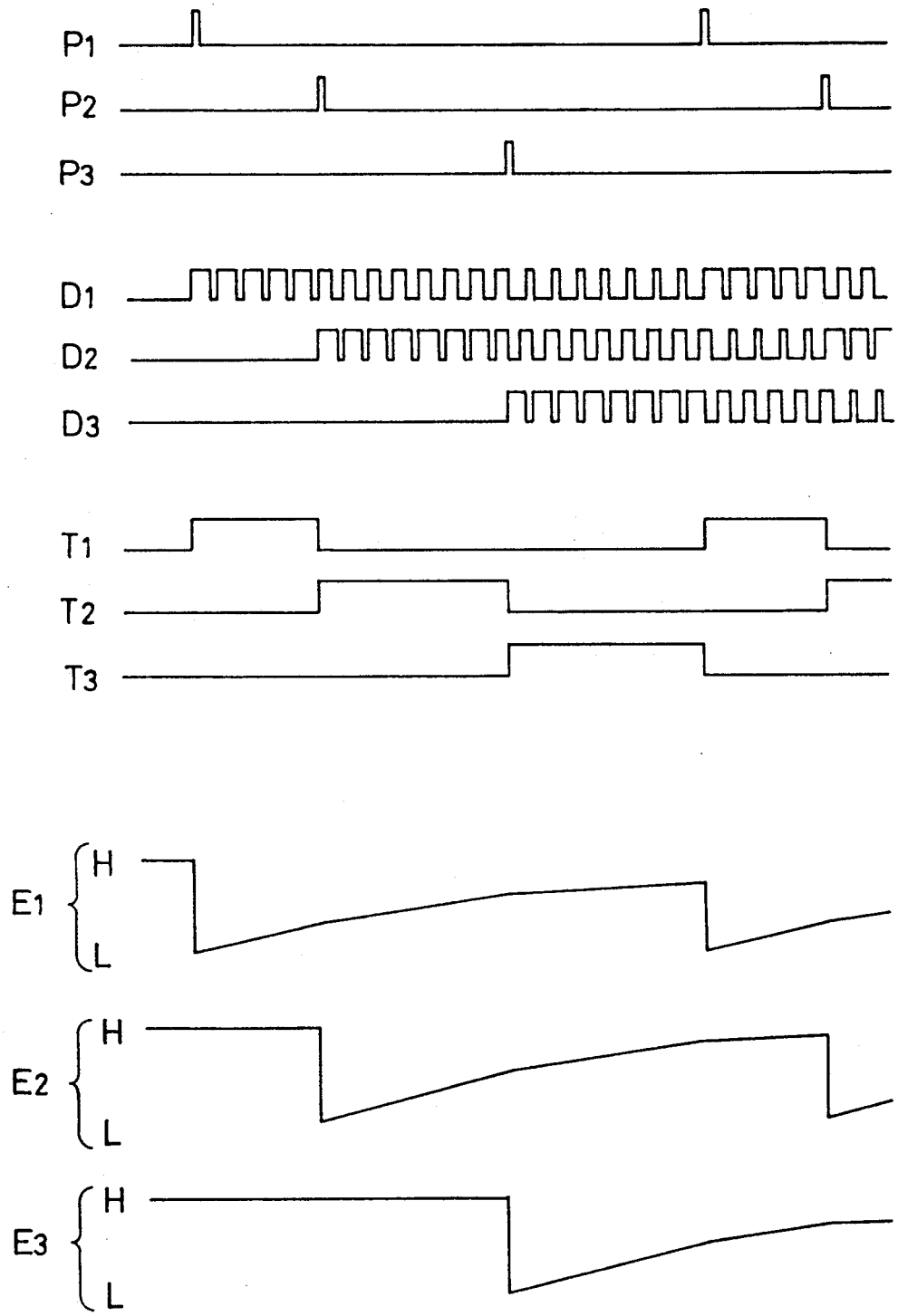
FIG. 3 is a waveform diagram of several signals.

FIG. 2 shows an example of the time constant circuit 4. Specifically, in time constant circuits 4*a*, 4*b* and 4*c* for generating three envelope signals E1, E2 and E3 corresponding to three acoustic data, switches 15*a*, 15*b* and 15*c* turn on upon receipt of the start signals P1, P2 and P3 of the generation timing as shown in FIG. 3, and during ON period, capacitors C1, C2 and C3 are charged. Switches 16*a*, 16*b* and 16*c* are supplied with pulse signals D1, D2 and D3 as shown in FIG. 3. Each of the pulse signals D1, D2 and D3 is a signal which is composed of a plurality of pulse signals of different duty in conformity with the generation timing of each acoustic data. Specifically, the pulse signal D1 is composed of a waveform of duty cycle=3:1 during the timing T1 period or between the start signals P1 and P2, a waveform of duty cycle=1:1 during the timing T2 period or between the start signals P2 and P3, and a waveform of duty cycle=1:3 during the timing T3 period or between the start signals P3 and P1, and this pulse signal is supplied to the switch 16*a* to control discharging of the capacitor C1. The pulse signal D2 is composed of a waveform of duty cycle=3:1 during the timing T2 period, a waveform of duty cycle=1:1 during the timing T3 period, and a waveform of duty cycle=1:3 during the timing T1 period, and this pulse signal is supplied to the switch 16*b* to control discharging of the capacitor C2. The pulse signal D3 is composed of a waveform of duty cycle=3:1 during the timing T3 period, a waveform of duty cycle=1:1 during the timing T1 period, and a waveform of duty cycle=1:3 during the timing T2 period, and this pulse signal is supplied to the switch 16*c* to control discharging of the capacitor C3.

Consequently, the envelope signal E1 delivered increases in terms of the time constant in the order of the timing T1, T2 and T3, or becomes gradually gentle in terms of the waveform inclination as shown in FIG. 3. The envelope signal E2 delivered increases in terms of the time constant in the order of the timing T2, T3 and T1, or becomes gradually gentle in terms of the waveform slope as shown in FIG. 3. Further, the envelope signal E3 delivered increases in terms of the time constant in the order of the timing T3, T1 and T2, or becomes gradually gentle in terms of the waveform slope as shown in FIG. 3.

OPERATION

Assuming that the sound "do" is produced at the timing T1, sound "re" is produced later at the timing T2, and the sound "mi" is produced still later at the timing T3, the process of combining these sounds in succession to produce a melody of "do-re-mi" will be described.

To produce the first sound "do", the counter 6 begins counting at the timing T1 in response to the output signal of the control circuit 5, and in accordance with the count of the counter 6, the first acoustic data stored in the ROM 1 is read out and supplied to the D-A converter 9.

On the other hand, the timing signal T1 and the start signal P1 are supplied from the control circuit 5 to the time constant circuit 4. In the time constant circuit 4*a* shown in FIG. 2, since the capacitor C1 is charged in response to the start signal P1 and the pulse signal D1 is supplied concurrently with the start signal P1, the discharging of the capacitor C1 is controlled or changed upon each timing, and thus, the foregoing envelope signal E1 is generated. Since this envelope signal is supplied to the D-A converter 9, the acoustic data supplied from the ROM 1 is converted in the D-A converter 9 from digital to analog form and concurrently envelope-processed by the use of the envelope signal E1. The resulting signal from the D-A converter 9 is emitted from the speaker 14 in the form of sound after passing through the mixing circuit 12 and the amplifier 13.

Then, to produce the second sound "re", the counter 7 begins counting at the timing T2 in response to the output signal of the control circuit 5, and in accordance with the count of the counter 7, the second acoustic data stored previously in the ROM 2 is read out and supplied to the D-A converter 10.

On the other hand, the timing signal T2 and the start signal P2 of generation timing are supplied from the control circuit 5 to the time constant circuit 4. In the time constant circuit 4*b* shown in FIG. 2, since the capacitor C2 is charged in response to the start signal P2 and the pulse signal D2 is supplied concurrently with the start signal P2, the discharging of the capacitor C2 is controlled or changed upon each timing, and thus, the foregoing envelope signal E2 is generated. Since this envelope signal is supplied to the D-A converter 10, the acoustic data supplied from the ROM 2 is converted in the D-A converter 10 from digital to analog form and concurrently envelope-processed using the envelope signal E2, and the resulting signal is supplied to the mixing circuit 12.

Since the time constant of the envelope signal E1 is changed in conformity with the generation timing of the second sound "re" as described above, the first sound "do" is envelope-processed at the timing T2 using the envelope signal E1 with its time constant changed, and supplied from the D-A converter 9 to the mixing circuit 12. Therefore, the acoustic data from the D-A converters 9 and 10 are combined in the mixing circuit 12, that is, the sound "re" just produced and the sound "do" produced a little earlier are combined, and the resulting composite sound is emitted from the speaker 14 after passing through the amplifier 13.

Then, to produce the third sound "mi", the counter 8 begins counting at the timing T3 in response to the output signal of the control circuit 5, and in accordance with the count of the counter 8, the third acoustic data stored in the ROM 3 is read out and supplied to the D-A converter 11.

On the other hand, the timing signal T3 and the start signal P3 of generation timing are supplied from the control circuit 5 to the time constant circuit 4. In the time constant circuit 4*c* shown in FIG. 2, since the capacitor C3 is charged in response to the start signal P3 and the pulse signal D3 is supplied concurrently with the start signal P3, the discharging of the capacitor C3 is controlled or changed upon each timing, and thus, the foregoing envelope signal E3 is generated. Since this envelope signal is supplied to the D-A converter 11, the acoustic data supplied from the ROM 3 is converted in the D-A converter 11 from digital to analog form and concurrently envelope-processed using the envelope signal E3, and the resulting signal is supplied to the mixing circuit 12.

Since the time constant of the envelope signal E1 is changed in synchronism with the generation timing of the third sound "mi" as described above, the first sound "do" is envelope-processed at the timing T3 using the envelope signal E1 with its time constant changed, and supplied from the D-A converter 9 to the mixing circuit 12. At the same time, since the time constant of the envelope signal E2 is changed in synchronism with the generation timing of the third sound "mi" as described above, the second sound "re" is envelope-processed at the timing T3 using the envelope signal E2 with its time constant changed, and supplied from the D-A converter 10 to the mixing circuit 12. Therefore, the acoustic data blocks from the D-A converters 9, 10 and 11 are combined in the mixing circuit 12, that is, the sound "mi" just produced, the sound "re" produced a little earlier, and the sound "do" produced still a little earlier are combined, and the resulting composite sound is emitted from the speaker 14 after passing through the amplifier 13.

In the foregoing configuration, with respect to each sound, each envelope signal is generated in synchronism with the generation timing of each sound, and the time constant of each envelope signal is changed in synchronism with each generation timing of the second, third sounds. Since each generated sound is enveloped-processed by the use of the corresponding envelope signal, the strength of each sound never increases nor decreases at any point of time. Since a plurality of sounds envelope-processed using the envelope signals are combined, there can be obtained a virtually-natural composite sound.

Figure 4:
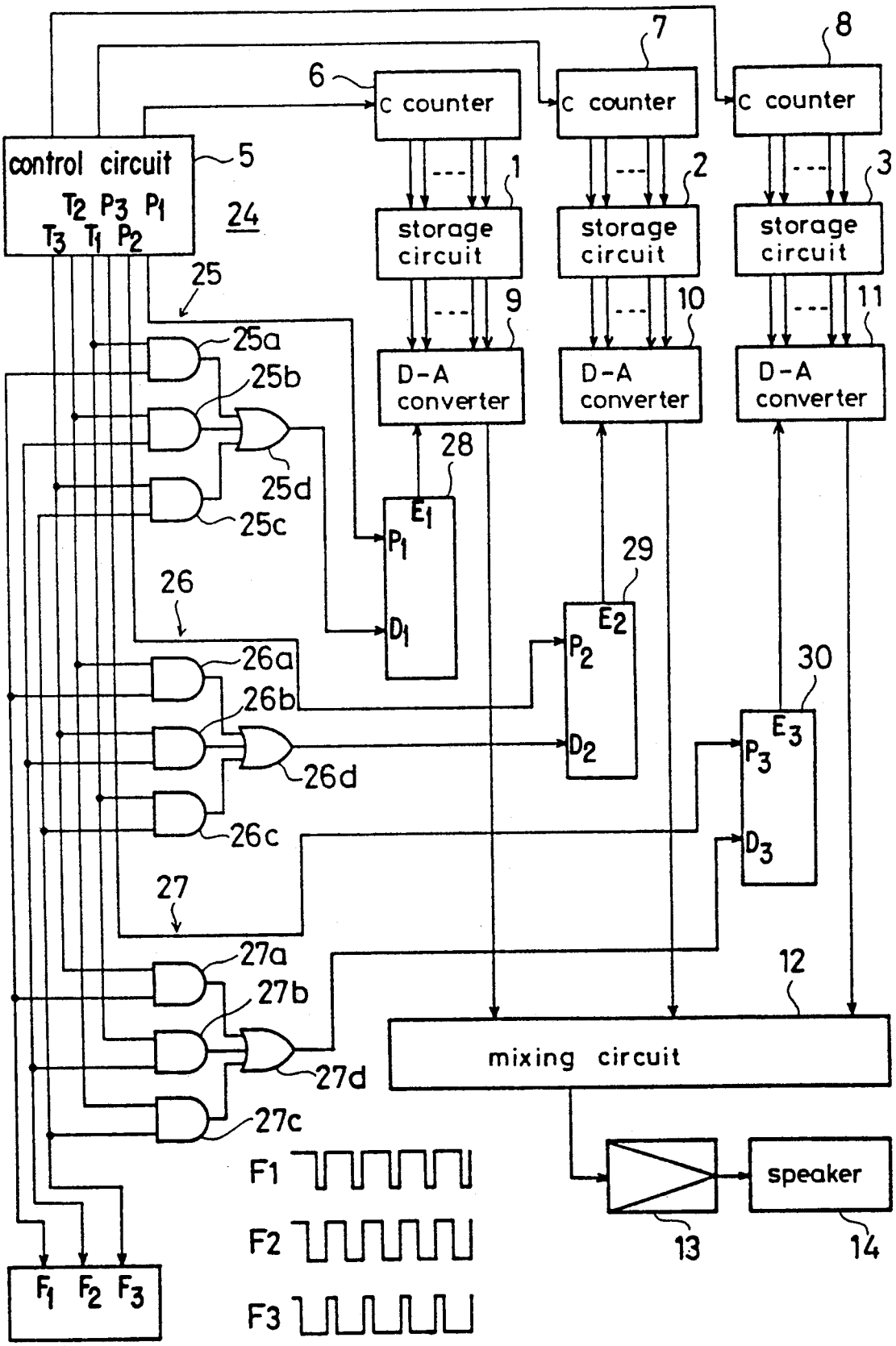
FIG. 4 is a block diagram showing another embodiment of the present invention.

In an embodiment shown in FIG. 4, a time constant circuit 24 comprises pulse signal composing circuits 25, 26 and 27 and envelope signal composing circuits 28, 29 and 30. The pulse signal composing circuits 25, 26 and 27 generate the foregoing pulse signals D1, D2 and D3. Specifically, each pulse signal composing circuit 25; 26; 27 comprises three AND circuits 25*a*, 25*b* and 25*c*; 26*a*, 26*b* and 26*c*; 27*a*, 27*b* and 27*c*, and one OR circuit 25*d*; 26*d*; 27*d*. Supplied to the two input terminals of each AND circuit is a combination of the timing signals T1, T2 and T3, a pulse signal F1 of duty cycle=3:1, a pulse signal F2 of duty cycle=1:1, and a pulse signal F3 of duty cycle=1:3. Describing in greater detail, the signals T1 and F1 are supplied to the AND circuit 25*a*, the signals T2 and F2 to the AND circuit 25*b*, the signals T3 and F3 to the AND circuit 25*c*, the signals T2 and F1 to the AND circuit 26*a*, the signals T3 and F2 to the AND circuit 26*b*, the signals T1 and F3 to the AND circuit 26*c*, the signals T3 and F1 to the AND circuit 27*a*, the signals T1 and F2 to the AND circuit 27*b*, and the signals T2 and F3 to the AND circuit 27*c*. The output signals of the AND circuits 25*a*, 25*b* and 25*c* are supplied to the OR circuit 25*d* to generate the pulse signal D1. The output signals of the AND circuits 26*a*, 26*b* and 26*c* are supplied to the OR circuit 26*d* to generate the pulse signal D2. The output signals of the AND circuits 27*a*, 27*b* and 27*c* are supplied to the OR circuit 27*d* to generate the pulse signal D3.

The envelope signal composing circuits 28, 29 and 30 are supplied with the pulse signals D1, D2 and D3 from the pulse signal composing circuits 25, 26 and 27, respectively, and with the start signals P1, P2 and P3 of generation timing, respectively, from the control circuit 5, thereby generating the envelope signals E1, E2 and E3, respectively.

The generation of the envelope signals E1, E2 and E3 will now be described in greater detail.

When the timing signal T1 is supplied to the AND circuit 25*a*, the AND circuit 25*a* delivers the pulse signal F1, so that its waveform of duty cycle=1:3 is delivered from the OR circuit 25*d*. Subsequently, when the timing signal T2 is supplied to the AND circuit 25*b*, the AND circuit 25*b* delivers the pulse signal F2, so that its waveform of duty cycle=1:1 is delivered form the OR circuit 25*d*. Further subsequently, when the timing signal T3 is supplied to the AND circuit 25*c*, the AND circuit 25*c* delivers the pulse signal F3, so that its waveform of duty cycle=1:3 is delivered form the OR circuit 25*d*. The pulse signal D1 shown in FIG. 3 is formed in the foregoing manner and supplied to the envelope signal composing circuit 28, and upon application of the start signal P1, the envelope signal E1 shown in FIG. 3 is supplied from the envelope signal composing circuit 28 to the D-A converter 9.

Since the envelope signal E2 is generated in response to the start signal P2, in the same manner as above, the pulse signal F1 is supplied from the AND circuit 26*a* to the OR circuit 26*d* in response to the timing signal T2, and the pulse signals F2 and F3 are supplied from the AND circuits 26*b* and 26*c* to the OR circuit 26*d* in response to the timing signals T3 and T1, successively. Therefore the pulse signal D2 is composed and thus, the envelope signal E2 is supplied to the D-A converter 10.

Since the envelope signal E3 is generated in response to the start signal P3, in the same manner as above, the pulse signal F1 is supplied from the AND circuit 27*a* to the OR circuit 27*d* in response to the timing signal T3, and the pulse signals F2 and F3 are supplied from the AND circuits 27*b* and 27*c* to the OR circuit 27*d* in response to the timing signals T1 and T2, successively. Therefore, the pulse signal D3 is composed and thus, the envelope signal E3 is supplied to the D-A converter 11.

The acoustic synthesization in this embodiment is identical with that described in connection with the configuration of FIG. 1.

Figure 5:
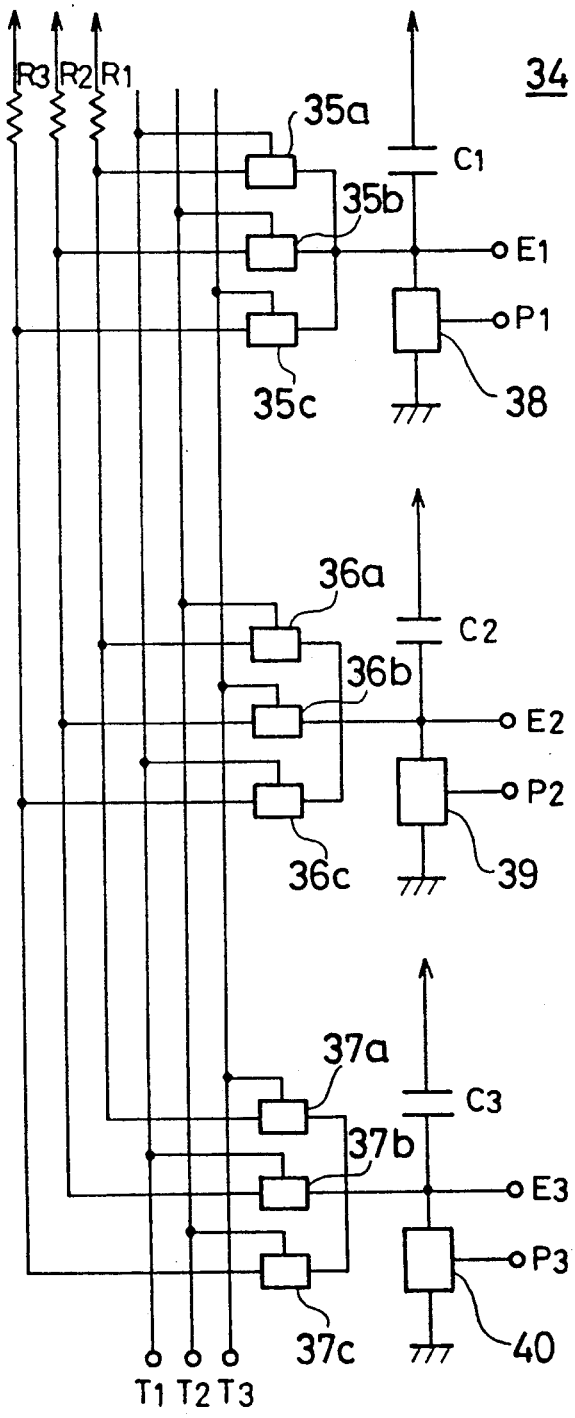
FIG. 5 is a circuit diagram showing another example of the time constant circuit.

In an embodiment shown in FIG. 5, a time constant circuit 34 is provided with a plurality of resistors of different resistance and designed so that the resistors can be selected in conformity with the generation timing of the acoustic data. Specifically, there are three resistors RI, R2 and R3 whose resistances are set such that R1<R2<R3, the resistor R1 is connected to switches 35*a*, 36*a* and 37*a*, the resistor R2 is connected to switches 35*b*, 36*b* and 37*b*, and the resistor R3 is connected to switches 35*c*, 36*c* and 37*c*. The switches 35*a*, 36*c* and 37*b* turn on in response to the timing signal T1, the switches 35*b*, 36*a* and 37*c* turn on in response to the timing signal T2, and switches 35*c*, 36*b* and 37*a* turn on in response to the timing signal T3. Switches 38, 39 and 40 turn on in response to the start signals P1, P2 and P3, respectively.

The generation of the envelope signals E1, E2 and E3 will be described in greater detail.

When the capacitor C1 is charged in response to the start signal P1 and the timing signal T1 is supplied to the switch 35*a*, a time constant circuit is formed by the capacitor C1 and the resistor R1; since the resistance of the resistor R1 is small, an envelope signal is generated whose waveform slope is large as is a portion, corresponding to the timing signal T1, of the envelope signal E1 shown in FIG. 3. Subsequently, when the timing signal T2 is supplied to the switch 35*b*, a time constant circuit is formed by the capacitor C1 and the resistor R2; since the resistance of the resistor R2 is somewhat large, an envelope signal is generated whose waveform slope is somewhat gentle as is a portion, corresponding to the timing signal T2, of the envelope signal E1 shown in FIG. 3. Further subsequently, when the timing signal T3 is supplied to the switch 35*c*, a time constant circuit is formed by the capacitor C1 and the resistor R3; since the resistance of the resistor R3 is large, an envelope signal is generated whose waveform slope is gentle as is a portion, corresponding to the timing signal T3, of the envelope signal E1 shown in FIG. 3. In this way, the envelope signal E1 whose time constant is changed at the generation timing of each acoustic data is supplied to the D-A converter 9 in the same manner as above. The operation of generation of the envelope signals E2 and E3 is substantially identical with that of the envelope signal E1.

The acoustic synthesization in this embodiment is identical with that described in connection with the configuration of FIG. 1.

In the acoustic synthesizer according to the present invention as disclosed above, since the time constant of the envelope signal corresponding to each acoustic data generated is changed at each generation timing of the second and third acoustic data generated later, the composite sound formed out of a plurality of acoustic signals envelope-processed using the envelope signals changed involves no unnaturalness even at the point of sound overlapping; therefore, three sounds, for example, can be combined just enough to become a good composite sound.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

This invention is related to the invention disclosed in co-pending U.S. patent application Ser. No. 07/760,312 filed Sep. 16, 1991 entitled Acoustic Signal Synthesizer, of the same inventor, and filed concurrently herewith, the contents of which are incorporated herein by reference.

What is claimed is:

1. An acoustic signal synthesizer comprising
means for storing a plurality of different acoustic data;
a plurality of D/A converters;
a separate one of said D/A converters connected to receive each of said different acoustic data;
means connected to mix the outputs of said D/A converters;
separate envelope generating means for each of said different acoustic data, said envelope generating means being connected to apply output envelope signals to separate respective D/A converters; and
control means connected to control said storing means to output a selected acoustic data and to simultaneously control the respective envelope generating means to output an envelope signal, said control means further comprising means for changing the time constant of the envelope signal in synchronism with the generation timing of another later generated acoustic data.

2. The acoustic signal synthesizer of claim 1 wherein each of said envelope generating means comprises a separate time constant circuit corresponding to each acoustic data, and said control means comprises means for charging the respective time constant circuit and then initiating the discharge thereof, at the time of controlling said output of the respective acoustic data.

* * * * *